US006447194B2

(12) United States Patent
Bonningue

(10) Patent No.: US 6,447,194 B2
(45) Date of Patent: Sep. 10, 2002

(54) DISPENSING ADAPTER, DISPENSER EQUIPPED WITH A DISPENSING ADAPTER, AND METHOD OF USING SAME

(75) Inventor: Philippe Bonningue, Paris (FR)

(73) Assignee: L'Oréal S.A., Paris (FR)

( * ) Notice: Subject to any disclaimer, the term of this patent is extended or adjusted under 35 U.S.C. 154(b) by 0 days.

(21) Appl. No.: 09/758,351

(22) Filed: Jan. 12, 2001

(30) Foreign Application Priority Data

Jan. 12, 2000 (FR) ..... 00 00350

(51) Int. Cl.[7] ..... B43M 11/06

(52) U.S. Cl. ..... 401/186; 401/214; 401/264

(58) Field of Search ..... 401/186, 202, 401/206, 213–216, 260, 262–264; 222/511, 543

(56) References Cited

U.S. PATENT DOCUMENTS

| | | | | |
|---|---|---|---|---|
| 1,922,204 A | * | 8/1933 | Johnson | 222/494 |
| 1,945,872 A | * | 2/1934 | Tappe | 222/496 |
| 3,819,285 A | | 6/1974 | Andrews et al. | |
| 4,217,994 A | * | 8/1980 | Koenig et al. | 222/212 |
| 5,277,510 A | * | 1/1994 | Okamoto et al. | 401/214 |

FOREIGN PATENT DOCUMENTS

| | | |
|---|---|---|
| DE | 90 13 168 | 2/1992 |
| EP | 0 633 195 | 1/1995 |
| GB | 795 304 | 5/1958 |

* cited by examiner

*Primary Examiner*—Gregory Huson
*Assistant Examiner*—Peter deVore
(74) *Attorney, Agent, or Firm*—Finnegan, Henderson, Farabow, Garrett, & Dunner, L.L.P.

(57) ABSTRACT

A dispenser for dispensing a product. The dispenser comprises a container for containing a product. The container comprising a body having at least one deformable wall and an opening. The dispenser also comprises a dispensing adapter on the container. The dispensing adapter has a flow passage to be placed in flow communication with the opening of the container, and an outlet orifice forming a seat. A closure is configured to be received in a sealed position on the seat. A mount connects the closure to the dispensing adapter. At least a portion of the mount is elastically deformable and is configured such that force applied to the closure moves the closure away from the seat so as to allow the product to flow through the outlet orifice, and the closure elastically returns to the sealed position on the seat when the force is removed.

58 Claims, 4 Drawing Sheets

DISPENSING ADAPTER, DISPENSER EQUIPPED WITH A DISPENSING ADAPTER, AND METHOD OF USING SAME

In general, the present invention relates to a packaging and dispensing device equipped with a dispensing adapter for dispensing products, and more particularly, a dispenser for dispensing a cosmetic product, a pharmaceutical product, or a dermatological product. For example, the dispenser can be used to dispense a shampoo, a gel, a makeup product, a care product, or a body lotion.

In the field of cosmetics, emphasis is placed on researching new series of movements for dispensing and/or applying a product.

Among the criteria to be considered in the process of developing new packaging and dispensing features are the practicality, the cleanliness, the comfort (particularly upon application), the economy of production and possibly the enjoyment of the feature.

Numerous solutions have been proposed, with greater or lesser commercial success, for the packaging and dispensing of such products. Some of these solutions having prohibitive drawbacks, particularly with regard to their cost or their ease of use.

One possible aspect of the present invention provides a packaging and dispensing unit which allows clean and easy dispensing of the product.

Another possible aspect of the invention provides a packaging and dispensing unit equipped to allow good preservation of the product contained in the container.

Yet another possible aspect provides a packaging and dispensing unit which is economical to produce, simple to use and which provides easier control over the amount of product dispensed.

Yet another possible aspect of the invention provides a packaging and dispensing dispenser which has characteristics for applying the product to a surface.

Still other possible aspects will become apparent in the description which follows. It should be understood that the invention could be practiced without achieving one or more of the above-mentioned aspects or the aspects described in the following.

According to an embodiment of the invention, a dispenser is disclosed for packaging and dispensing of a product, particularly a cosmetic product. The dispenser comprises a container containing the product, the container comprising a body with deformable walls, preferably elastically deformable walls, one end of which is closed by a bottom and the other end of which delimits an opening on which a dispensing adapter is mounted. The dispensing adapter comprises an inlet orifice intended to be placed in communication with the container and an outlet orifice forming a seat capable of receiving a closure in a sealed position, the closure being connected to the dispensing adapter via a mount. Elastically deformable means are provided for, in response to force exerted directly on the closure externally to the dispensing adapter, allowing the closure to move away from the seat so as to at least partially uncover the outlet orifice and thus allow the product out, the closure returning in a sealed manner on the seat by elastic return of the elastically deformable means when the stress ceases to be applied.

The term "sealed position" denotes at least sealing against flow of the product. As will be seen later, it is possible to provide a microleakage between the closure and the seat, so as to allow air intake when the closure is in the sealed position.

Thus, the closure can play a part in preserving the product and allow cleaner dispensing of product. Furthermore, the opening of the outlet orifice can be controlled and brought about by mechanical stress exerted from the outside of the dispensing adapter or under the thrust of the product. This allows for better control over the dispensing of the product, particularly when the issue is one of dispensing to a localized area. In addition, the user can control the rate at which the product leaves the container by exerting greater or lesser pressure on the deformable walls of the container.

The sealing of the closure on the seat may depend on the viscosity of the product. Thus, the conditions for obtaining a seal may not be the same for a composition of low viscosity as they are for a composition of high viscosity. The seal may be adjusted by altering the elastic return force exerted by the mount.

Optionally, the elastically deformable means include at least one part of the mount. The elastic deformation may be from elastic elongation or bending, and may involve all or part of the mount. For example, in the case of a portion which deforms in elastic elongation, that portion may be made of elastomeric material. In the case of a portion which deforms by bending, that portion may be made using non-elastomeric thermoplastics, for example polypropylenes. The deforming portion can then be configured to have elastic bending properties. According to another embodiment, the elastic means may include auxiliary means, for example a spring.

In another embodiment of the invention, the closure is designed to be able to move away from the seat in response to the movement of the closure in engagement on a surface capable of receiving the product to be dispensed, for example, in a movement roughly parallel to the surface. By moving the closure to press against a surface intended to take the dispensed product, the closure is forced to move away from its seat. One example of a surface is a hand. In the case of where the closure is formed in the shape of a ball or sphere, the orifice is uncovered by causing the ball to roll against the hollow of the hand. This forces the ball to fully or partially cross the edge delimiting the seat into which the outlet orifice opens. As a result, the outlet orifice is uncovered in full or in part, allowing the product contained in the container to flow under the effect of its weight and/or under the effect of pressure which may be exerted on the walls of the container. The amount dispensed can thus be controlled more precisely. Furthermore, the closure can then be used to massage the surface onto which the product is to be applied to encourage the product to penetrate.

Optionally, the closure is moved off its seat using a finger of the hand holding the container, while the product may be pressurized via the flexible walls of the container using the other hand if desired.

The closure may be configured in some form other than the form of a ball, so long as the shape can allow sealing of outlet orifice, and also allow a mechanical stress to be exerted on the closure from outside the adapter. In addition, the shape of the closure should allow the closure to move with respect to the seat to at least partially uncover the orifice in response to the force.

Alternatively, and aside from the possibility of moving the closure from outside the adapter, it is possible to cause the closure to move in response to a pressure exerted on the inside of the adapter by the product that is to be dispensed. In the embodiment where the closure is in the form of a ball, the product may flow all around the ball between the ball and the seat delimited by the outlet orifice. This arrangement allows the user to choose between at least two modes of dispensing the product.

In yet another embodiment, the closure comprises at least one portion of a spherical surface, and the seat is formed in the shape of a depression into which the outlet orifice opens. The form of the seat may be chosen so that the seat, in combination with the closure, makes a seal against the product, particularly over an annular zone of the outlet orifice. As mentioned previously, the closure may be formed as a complete sphere. The surface delimited by the seat and on which the closure presses can depend on the desired sealing and on the desired ease of opening. For example, in the case of a closure in the form of a ball, the seat can be produced in the form of a hemispherical cap with the corresponding dimensions to allow the ball to be moved off its seat when stressed externally. Alternatively, in the case of a closure in the form of a ball, the seat may be of frusto-conical shape. The seat is formed of an annular free edge delimiting the outlet orifice of the adapter, the cross-section of the free edge can be chosen according to the diameter of the closure so that the latter, in the absence of stress, can rest stably on the seat.

The mount may be made, fully or partially, of a material chosen from thermoplastic or crosslinked elastomers, for example, silicones, nitriles, natural or synthetic latices, ethylene propylene diene copolymers (EPDMs), polyurethanes, blends of polypropylene and styrene butadiene copolymer (SBS), styrene ethylene n-buthene copolymer (SEBS) or ethylene propylene diene copolymer (EPDM), very low-density polyethylenes, blends based on polyester glycols or thermoplastic polyurethane (TPUs) or polyether glycols ( polyether block amide (PEBAs) and elastomeric polyethylene terephthalate (COPEs)), and flexible polyvinyl chlorides (PVCs). Optionally, such a material may have a hardness of between 20 Shore A and 40 Shore D, and preferably between 40 Shore A and 75 Shore A. Its elasticity may range from 0.5 to 5 MPa, and preferably from 0.8 to 2 MPa (tensile stress at 100% elongation). These materials can also be used for making the closure.

The mount can be molded with the closure. The materials used for the closure and mount may be identical or different mutually-compatible materials. Such materials are capable, at the molding temperature, of forming chemical bonds with each other. The closure does not need to be made of elastomeric material. For example, the closure may be made of polyethylenes or polypropylenes.

The mount can comprise a connecting member, one end of which may be secured to the dispensing adapter by bonding, welding or by mechanical attachment. Examples of mechanical attachment include snap-fastening or cleating. Still other mechanical attachments may be used. Such attachments are widely used in the product packaging industry, particularly in the packaging of cosmetic products and therefore require no additional detailed description. Attachment preferably occurs inside the adapter, that is to say in a flow passage located between the inlet orifice and the outlet orifice. The means of attaching the mount on the adapter may themselves be configured to be elastically deformable, particularly in bending, so that they provide all or some of the elastic return for returning the closure to its seat.

Optionally, means are provided to allow the adapter to be fixed onto the container. For example, the dispensing adapter may be screwed, snap-fastened, welded or bonded onto the container. A removable lid may be provided to prevent the closure from moving away from its seat and causing product to be accidentally let out, particularly during transport. Thus, in the closed position, a lid may press against the closure to prevent any inadvertent movement thereof.

With respect to the container, the dispensing adapter may occupy a so-called "transport" position in which, even in the event of inadvertent overpressure inside the container, the product cannot get out. Such means are well known and operate, for example, on the basis of one or more orifices which can be placed selectively opposite each other.

In another aspect, the present invention comprises a dispenser for dispensing a product. The dispenser includes a container for containing a product, the container comprises a body having at least one deformable wall and an opening, a dispensing adapter on the container, the dispensing adapter having a flow passage to be placed in flow communication with the opening of the container and an outlet orifice forming a seat, a closure configured to be received in a sealed position on the seat, and a mount connecting the closure to the dispensing adapter. At least a portion of the mount being elastically deformable and being configured such that force applied to the closure moves the closure away from the seat so as to allow the product to flow through the outlet orifice. The closure elastically returns to the sealed position on the seat when the force is removed.

In another aspect, the dispensing adapter includes an attachment element on an internal surface of the dispensing adapter, and the mount includes a loop member securing the mount to the attachment element.

In a further aspect, the dispensing adapter includes a cavity defined by an internal surface of the adapter, the mount being secured in the cavity.

In yet another aspect, the body of the container is substantially cylindrical.

In a further aspect, at least a portion of the mount is deformable by elastic elongation.

In yet a further aspect, the mount includes a connecting member having an end connected to the closure, the connecting member is deformable.

In another aspect, at least a portion of the mount deforms elastically in bending.

In a further aspect, the force is generated by the pressure of the product on the closure.

In another aspect, the force is generated by the contact of the closure with a surface to which the product is to be applied.

In yet another aspect, the force is exerted directly on the closure external to the dispensing adapter.

In a further aspect, at least a portion of the closure is a least partially spherical and the seat is shaped to receive the portion of the closure.

In another aspect, the wall is elastically deformable.

In a further aspect, the closure and the mount are formed from the same material.

In yet another aspect, the mount includes a cross-shaped member attached to a connecting member.

In another aspect, the dispenser further comprises a product in the container.

In yet a further aspect, the product is chosen from a cosmetic product, a hair care product, a sun care product, a make-up product, and a personal hygiene product.

In another aspect, the mount is secured to the dispensing adapter by one of bonding, welding, and mechanical attachment.

In yet another aspect, the body of the container includes a first threading, and the dispensing adapter includes a second threading. The second threading engages the first threading to secure the dispensing adapter to the container.

In yet another aspect, the present invention further comprises a removable lid configured to immobilize the closure in the sealed position.

In yet another aspect, pressure applied to the deformable wall of the container causes the product to apply the force.

In yet another aspect, the present invention comprises a method for dispensing a product on a surface. The method comprises providing a dispenser described above, applying a force to the closure to move the closure away from the seat, flowing product from the outlet orifice and onto a surface, and releasing the force on the closure to cause elastic return of the closure.

In yet another aspect, the method comprises massaging the product into the surface using the closure.

In a further aspect, the applying of the force to the closure includes pressing the closure against the surface.

In another aspect, the method further comprises pressing the deformable wall to cause the product to apply the force.

In a further aspect, the surface includes at least one of skin and hair.

In yet a further aspect, the product is chosen from a cosmetic product, a hair care product, a sun care product, a make-up product, and a personal hygiene product.

In yet another aspect, the present invention comprises an apparatus for attachment to a container to dispense a product. The apparatus comprises a dispensing adapter having a flow passage intended to be placed in flow communication with a container, and an outlet orifice for dispensing a product, a closure configured to be received in a sealed position on the outlet orifice, and a mount comprising a connecting member. The connecting member has a first end connected to the closure and a second end connected to the flow passage of the dispensing adapter. The mount is elastic such that a force applied to the closure moves the closure from the sealed position allowing the product to flow through the outlet orifice, and the closure elastically returns to the sealed position when the force is removed.

In another aspect, the flow passage comprises a cavity, and the mount includes an attachment element attached to the second end of the connecting member, wherein the attachment element is secured within the cavity.

In a further aspect, the closure comprises a truncated sphere, and a passage passing through the truncated sphere. The connecting member passes through the passage of the truncated sphere.

In another aspect, the connecting member includes a cleat at the second end, the cleat engages the flow passage of the dispensing adapter.

In yet another aspect, the closure and mount are integrally molded, and an axial passage passes through the closure and mount.

Additional aspects of the invention will be set forth in part in the description which follows, and in part will be obvious from the description, or may be learned by practice of the invention. The aspects of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

FIG. 4A shows a section view of the dispensing adapter, FIG. 4B shows a perspective view of the closure and mount;

FIG. 8A shows a section view of the dispensing adapter, FIG. 8B shows a perspective view of the closure and mount.

Reference will now be made in detail to the exemplary embodiments of the invention, examples of which are illustrated in the accompanying drawings. Wherever possible, the same reference numbers will be used throughout the drawings to refer to the same or like parts.

Figure 1:
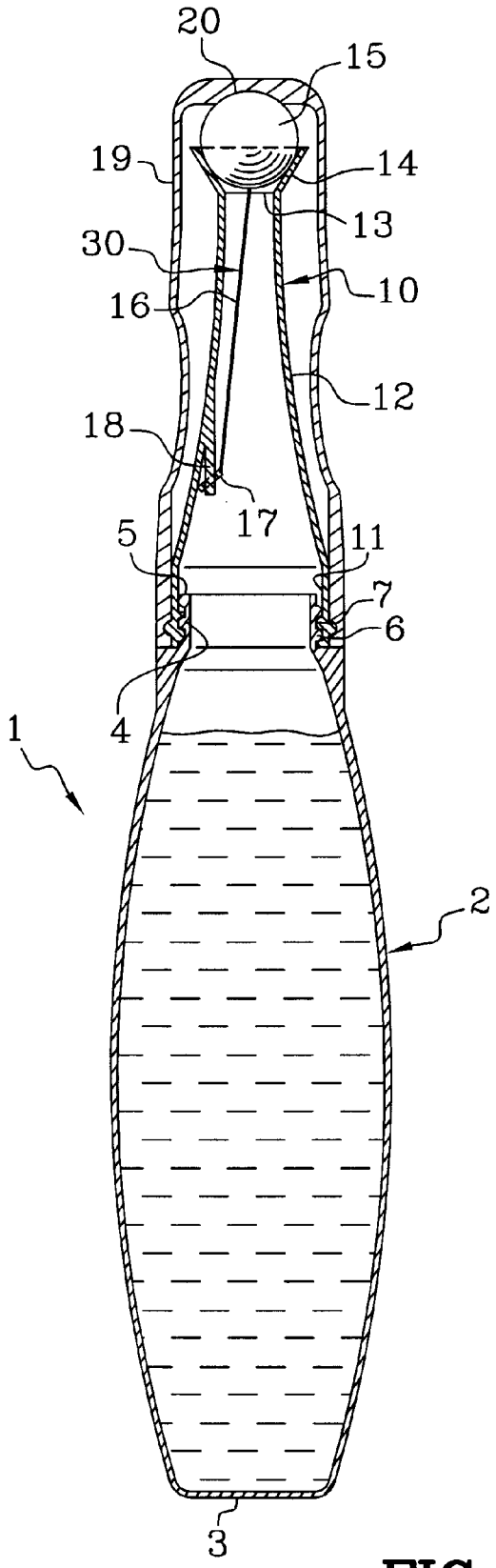
FIG. 1 shows a section view of a preferred embodiment of a dispenser equipped with a dispensing adapter according to the invention.

The dispenser 1, as seen in FIG. 1, comprises a container 2 having one end closed by a bottom 3, and the other end of forming a neck 4 ending in a free edge delimiting an opening 5. The neck 4 has a first threading 6 on its outer surface. The first threading 6 is capable of collaborating with a corresponding second threading 7 provided on an internal surface of a dispensing adapter 10. The container 2 is obtained from molding of a thermoplastic, such as polyethylene or polypropylene. The side walls of the container 2 are flexible and deformable under pressure to allow the product to be forced out via the dispensing adapter 10 which will be described below. For example, the pressure may be generated by the hands of the user. The product may be a shampoo, a body lotion, a make-up removal product, a sun lotion, or other cosmetic product.

Figure 2:
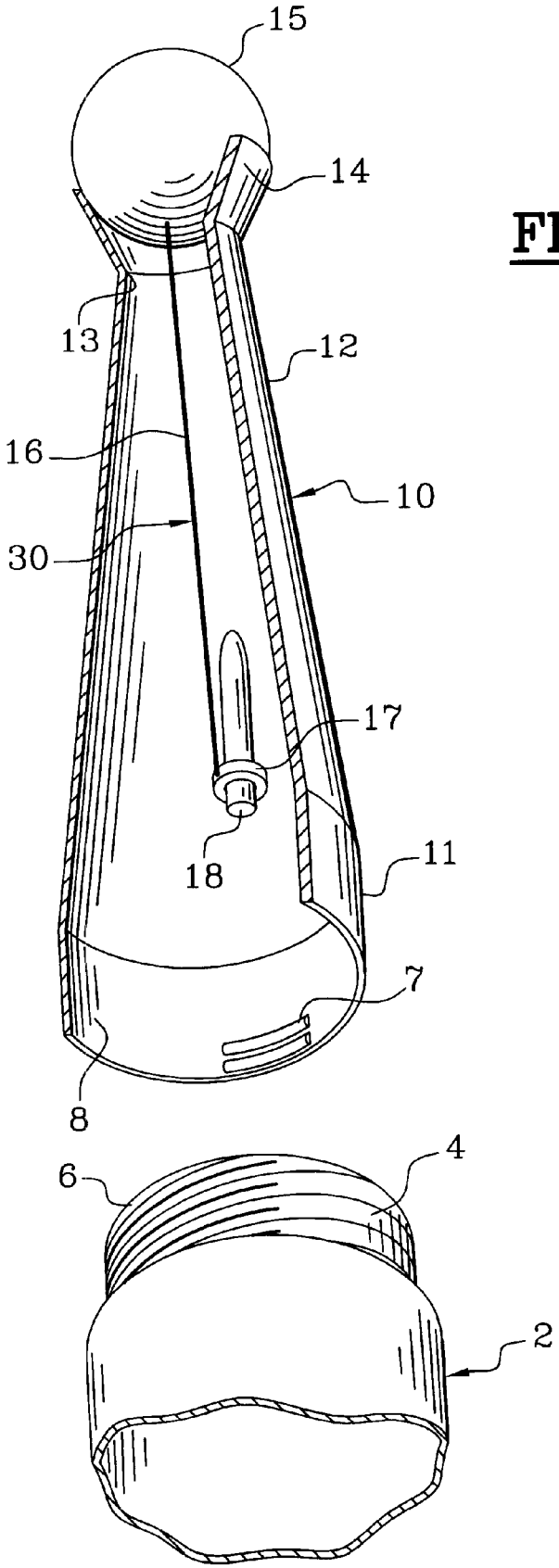
FIG. 2 shows a perspective sectioned view of the dispensing adapter mounted on the dispenser depicted in FIG. 1.

As seen in FIG. 2, the dispensing adapter 10 comprises a first cylindrical portion or cylindrical skirt 11. The first cylindrical portion has the second threading 7 formed on the internal surface of the first cylindrical portion 11. Applicant recognizes that other means could be used for fixing the adapter 10 on the container 2, for example, snap-fastening, bonding, or welding. The cylindrical portion 11 delimits a first opening or inlet orifice 8 for the product that is to be dispensed.

The cylindrical skirt 11 is extended by a frustoconical portion 12 which extends over a substantial portion of the dispensing adapter 10. The cross-section of the frustoconical portion 12 decreases in a direction facing away from the cylindrical skirt 11. The frustoconical portion 12 ends in an outlet orifice 13, which opens into an inverted frustoconical portion 14 of short height. The inverted frustoconical portion 14 forms a seat for a closure 15. The closure 15 is capable of selectively closing the outlet orifice 13. In a preferred embodiment, the closure 15 is in the shape of a sphere or ball, although different shapes will work as well. The dispensing adapter 10 can be molded using the same material as used to make the container 2.

Arranged at the top of the dispensing adapter 10 is the closure 15, which is secured to a mount 30. The mount 30 comprises a connecting member 16 which is made from an elastomeric material, for example, silicone. The connecting member 16 has a first end which is secured to the closure 15. Another end of the connecting member 16 is connected to a polypropylene loop 17 which can be attached to an attachment element 18. Attachment element 18 can be formed by molding inside the frustoconical portion 12. As shown in FIGS. 1 and 2, the closure 15 rests on the seat 14 and seals the outlet orifice 13 of the dispensing adapter 10. In this position, the connecting member 16 is partially taut to force the closure 15 against the seat 14. This force can be generated by the elastic return of the connecting member 16. Furthermore, in this position, there may be a microleakage between the seat 14 and the closure 15 to allow air intake when the closure is in position on the seat 14. A microleakage may be achieved by giving the seat 14 and/or the closure 15 an appropriate surface finish. Alternatively, the air intake may occur only at the time of closure.

According to another possible embodiment, the connecting member 16, the closure 15, and the attachment loop 17 may be obtained by molding all out of the same elastomeric material. Alternatively, the closure 15 and the attachment loop 17 are made of a first non-elastomeric material while the connecting member 16 is made of an elastomeric material. In this embodiment, the assembly can be obtained by two-shot injection molding. As another alternative, the various elements that make up the mount and the closure may be produced separately and assembled by bonding, welding or any other mechanical attachment.

The dispenser, as seen in FIG. 1, also comprises a removable lid 19 capable of immobilizing the closure 15 on its seat 14 in a closed position. This avoids accidentally dispensing products during transport. To assist in immobilizing the closure, a depression 20 may be formed on an internal face of the lid 19. This depression has a profile that can correspond to the profile of the closure 15.

Figure 3:
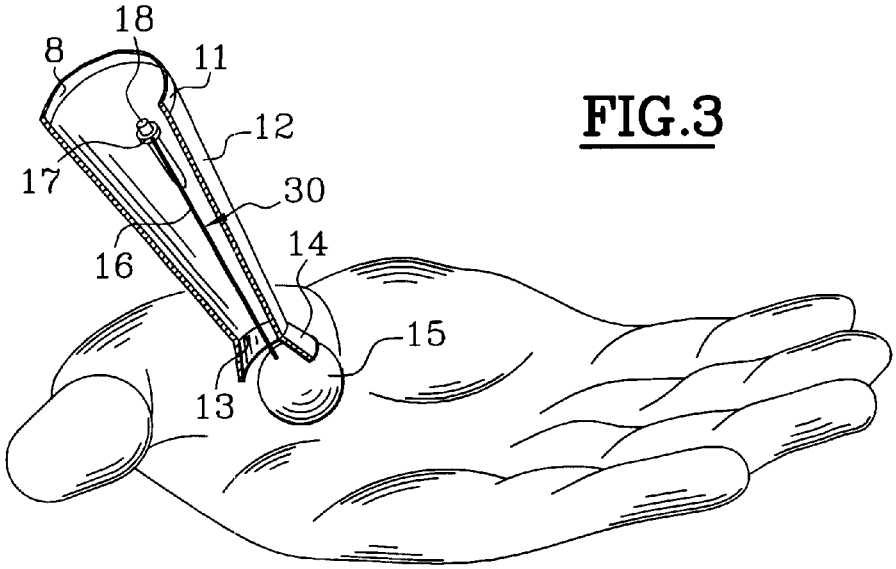
FIG. 3 shows an operation of the dispensing adapter according to one aspect of the invention.

FIG. 3 shows one preferred way to dispense the product. The user pushes the closure 15 slightly into the hollow of her hand and imparts a lateral movement in a direction roughly parallel to the surface of the hand to dispense the product. The closure 15, thus forced into the hollow of the hand, moves laterally with respect to the seat 14 partially uncovering the orifice 13. This movement of the closure 15 is accompanied by an elastic elongation of the connecting member 16. In this position when the orifice 13 is partially uncovered, the user exerts pressure on the side walls of the body of the container to cause the product to be dispensed. Alternatively, in the case of a more liquid product, the product may flow out naturally under the effect of its own weight.

When the user stops pressing the closure 15 onto the surface of the hand, the connecting member 16 exerts a force capable of returning the closure to sealed contact with the seat 14, closing the orifice 13. In this closed position, the closure 15 can be used as a member for massaging the surface onto which the product is applied to encourage the product to penetrate.

In another variation, the product may be let out by exerting pressure on the flexible walls of the container. The product thus pressurized, exerts enough pressure to lift the closure 15 off its seat 14 and the product emerges uniformly all around the closure.

Figure 4A:
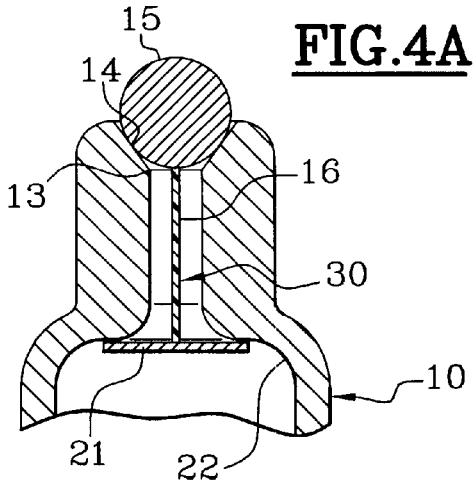
FIGS. 4A and 4B show partial views of a dispensing adapter according to a second embodiment of the invention.
Figure 4B:
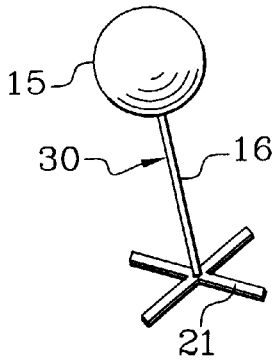

As seen in FIGS. 4A and 4*b*, a second embodiment of the mount 30 comprises an attachment member including a semi-rigid cross-shaped element 21. The cross-shaped element 21 is secured to one end of the elastic connecting member 16. The other end of the elastic connecting member 16 is secured to the closure 15. The elastic connecting member 16 is made of a material identical to the material of which the attachment member is made. The assembly can be formed by a two-shot injection molding.

To assemble the dispensing adapter, the operator inserts the cross-shaped member 21 into the passage that opens onto the outlet orifice 13. As he does so, the branches of the cross-shaped member 21 fold towards the connecting member 16 until they reach the zone of larger cross-section 22 in the flow passage of the dispensing adapter 10. When the cross-shaped member reaches the zone of larger cross-section 22, the branches of the cross-shaped member 21 can revert to their position of maximum deployment where they immobilize the assembly inside the adapter 10. According to this embodiment, the branches of the cross-shaped member 21 can bend in a direction away from their direction of bending during mounting. This adds to the elastic deformability of the mounting member 30. However, in a preferred embodiment, most of the elastic deformability stems from the elastic deformability of the connecting member 16.

In an alternative form (not depicted) of the previous embodiment, the elasticity results from the presence of a spring arranged between the member 21 and the connecting member 16. The spring is made of a rigid material and is effaced upon introduction by means of a stop.

Figure 5:
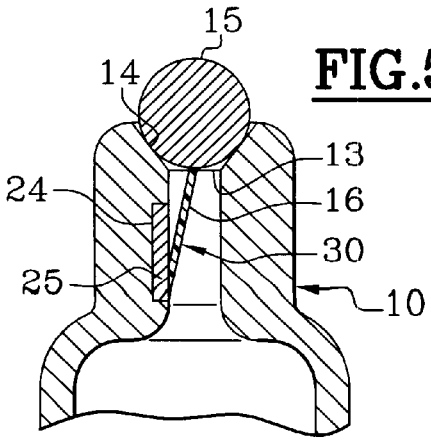
FIG. 5 shows a partial view of a dispensing adapter according to a third embodiment of the invention.

In the embodiment shown in FIG. 5, the attachment element 25 of the mount 30 includes a semi-rigid element which is snap-fastened, bonded or welded inside a cavity 24 formed on the interior surface of the adapter. The connecting member 16 connecting the attachment element 25 to the closure 15 is made of elastomer.

Figure 6:
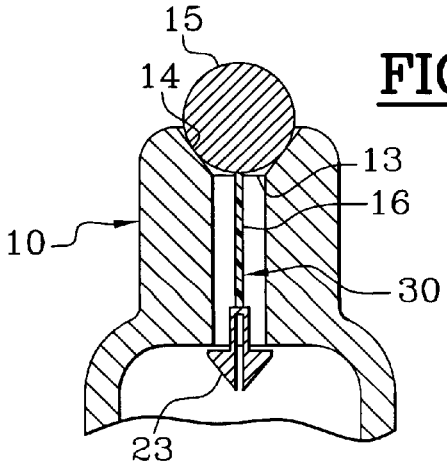
FIG. 6 shows a section view of a dispensing adapter according to a fourth embodiment of the invention.

In the embodiment shown in FIG. 6, the closure 15 is attached to the adapter 10 by means of a member forming a cleat 23 which, upon insertion in the adapter 10, is able to adopt a position of small bulk until such time that it reaches a zone of larger cross-section. At that instant, through elastic return, the cleat 23 deploys and secures the mount 30 and the closure 15 with respect to the dispensing adapter 10. Preferably, the member 23 and the closure 15 are made of polypropylene or polyethylene. Preferably, the connecting member 16 is made of nitrile elastomer.

Figure 7:
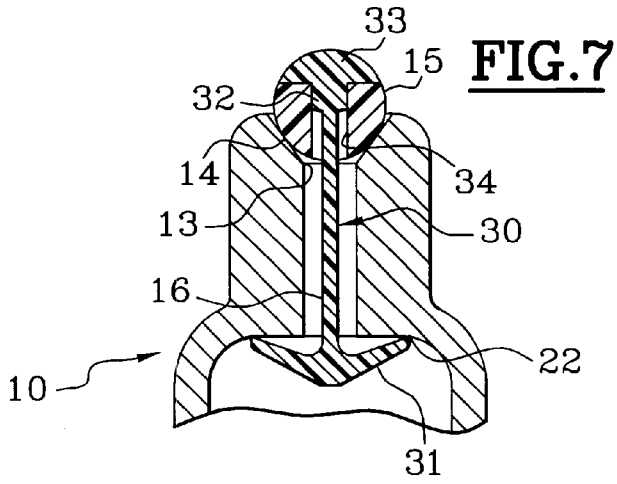
FIG. 7 shows a section view of a dispensing adapter according to a fifth embodiment of the invention.

In the embodiment shown in FIG. 7, the closure 15 is preferably made of silicone elastomer and is formed of a truncated sphere. A passage 34 passes through the center of the closure 15. The mount 30 includes a connecting member 16, one end of which is connected to an element forming a cleat 31 having at least two angularly spaced legs. The other end of the connecting member 16 is secured to a sphere portion 33 of a shape such that in the mounted position it acts as the complement of the truncated portion of the closure 15. The connecting member 16 has a portion 32 of larger cross-section which can be mounted tightly in the passage 34 to immobilize the mount 30 on the closure 15. The mount 30 is obtained by molding of a single piece, preferably out of polypropylene.

The mount 30 is assembled first with the closure 15. To do this, the legs of the cleat 31 are engaged inside the passage 34. The free ends of the legs of the cleat 31 bend towards the connecting member 16 until the passage 34 has been fully negotiated. Once the passage 34 has been fully negotiated, the legs can elastically revert to their position of maximum deployment. The translational movement of the mount 30 with respect to the closure continues until the portion 32 that fits tightly inside the passage 34 is fully engaged. The assembly is then positioned on the dispensing adapter 10. To do this, the legs of the cleat 31 are engaged inside the outlet passage of the dispensing adapter 10. In doing this, as the portion of reduced cross section of the dispensing adapter 10 is negotiated, the legs of the cleat 31 bend towards the connecting member 16. Upon reaching the portion of larger cross-section 22, the legs of the cleat 31 deploy, thus attaching the assembly formed of the mount 30 and of the closure 15 to the adapter 10.

Upon dispensing of product, in response to mechanical stress exerted on the closure 15, the legs of the cleat 31 bend elastically in a direction away from their direction of bending during assembly. The closure 15 moves with respect to the seat 14 so as to allow the product out. When the stress ceases to be applied, the legs of the cleat generate a force capable of elastically returning the closure to the closed position on the seat 14.

Figure 8A:
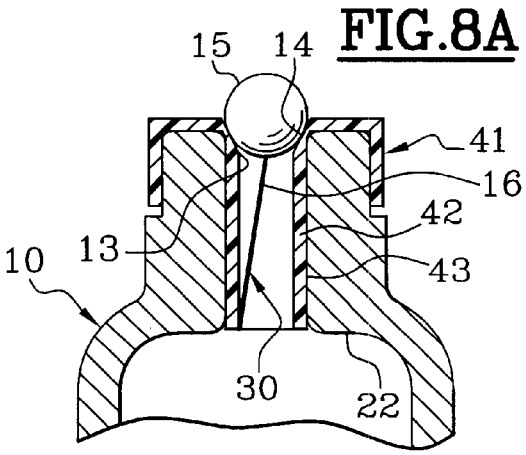
FIGS. 8A and 8B show partial views of a dispensing adapter according to a sixth embodiment of the invention.
Figure 8B:
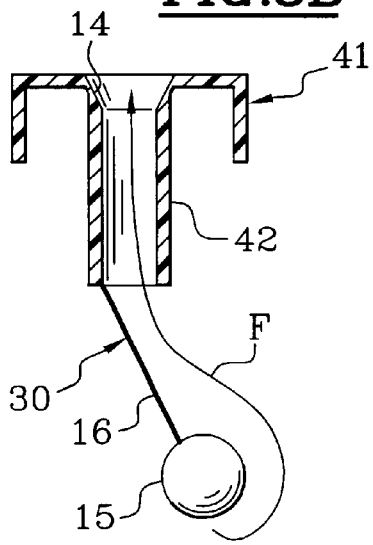

In the embodiments shown in FIGS. 8A and 8*b*, the mount 30 and the closure 15 are molded as a single piece, preferably made of a thermoplastic elastomer. The mount 30 comprises a U-shaped portion 41 which can be fixed to the end of the dispensing adapter 10 delimiting the outlet orifice 13. The U-shaped portion can be fixed by welding. An internal skirt 42 of the U-shaped portion extends over substantially the entire height of a passage of smaller cross-section 43 of the dispensing adapter 10. The internal skirt 42 is secured to a first end of a connecting member 16 connecting the U-shaped portion to the closure 15. After molding, the closure 15 is positioned correctly with respect to the mount 30 by insertion in the direction illustrated by arrow F in FIG. 8*b*. The passage of the closure 15 into the internal skirt 42 is possible because of the elasticity of the material. Upon dispensing, the operation is comparable with that of FIG. 5.

Figure 9:
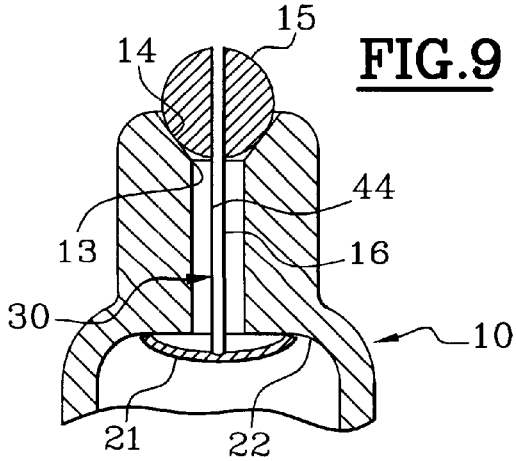
FIG. 9 shows a section view of a dispensing adapter according to a seventh embodiment of the invention.

The embodiment shown in FIG. 9 differs from that of FIGS. 4A and 4B in that the mount 30 and the closure 15 have an axial passage 44 passing through them and being capable of allowing the insertion of a tool in the form of a needle intended to make it easier for the assembly to be mounted on the dispensing adapter 10. Furthermore, according to this embodiment, the closure 15 and the mount 30 are obtained by molding, preferably of a polypropylene. The elastic deformability being a result of the elastic bending of the legs of the cross-shaped member 21 when stress is exerted on the closure 15.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A dispenser for dispensing a product, the dispenser comprising:

a container for containing a product, the container comprising a body having at least one deformable wall and an opening;

a dispensing adapter on the container, the dispensing adapter having a flow passage to be placed in flow communication with the opening of the container, and an outlet orifice forming a seat;

a closure configured to be received in a sealed position on the seat; and a mount connecting the closure to the dispensing adapter, the amount having an end secured to the closure, at least a portion of the mount being elasticallly deformable, wherein said at least a portion of the mount and the closure are configured such that force applied directly to the closure external to the dispensing adapter moves the closure away from the seat so as to allow the product to flow through the outlet orifice, the closure elastically returning to the sealed position on the seat when the force is removed.

2. A dispenser according to claim 1, wherein the dispensing adapter includes an attachment element on an internal surface of the dispensing adapter, and the mount includes a loop member securing the mount to the attachment element.

3. A dispenser according to claim 1, wherein the dispensing adapter includes a cavity defined by an internal surface of the adapter, the mount being secured in the cavity.

4. A dispenser according to claim 1, wherein the body of the container is substantially cylindrical.

5. A dispenser according to claim 1, wherein said at least a portion of the mount is deformable by elastic elongation.

6. A dispenser according to claim 5, wherein the mount includes a connecting member having the end secured to the closure, the connecting member being deformable.

7. A dispenser according to claim 1, wherein said at least a portion of the mount deforms elastically in bending.

8. A dispenser according to claim 1, wherein the mount is configured such that the closure moves away from the seat in response to force generated by the pressure of the product on the closure.

9. A dispenser according to claim 8, wherein pressure applied to the deformable wall of the container causes the force generated by the pressure of the product on the closure.

10. A dispenser according to claim 8, wherein the force generated by the pressure of the product on the closure is caused in response to deforming the deformable wall.

11. A dispenser according to claim 1, wherein at least a portion of the closure is a least partially spherical and the seat is shaped to receive said at least a portion of the closure.

12. A dispenser according to claim 11, wherein the closure is a sphere.

13. A dispenser according to claim 1, wherein at least one portion of the mount is formed from a material chosen from one of a thermoplastic and a cross-linked elastomer.

14. A dispenser according to claim 13, wherein the material is chosen from silicones, nitriles, natural lattices, synthetic lattices, ethylene propylene diene copolymers, polyurethanes, blends of polypropylene and styrene butadiene copolymer, blends of polypropylene and styrene ethylene n-buthene copolymer, blends of polypropylene and ethylene propylene diene copolymer, very low-density polyethylenes, polyester glycol blends, polyether glycols blends, and flexible polyvinyl chlorides.

15. A dispenser according to claim 1, wherein said wall is elastically deformable.

16. A dispenser according to claim 1, wherein the closure and the mount are formed from the same material.

17. A dispenser according to claim 1, wherein the mount includes a cross-shaped member attached to a connecting member.

18. A dispenser according to claim 1, further comprising a product in the container.

19. A dispenser according to claim 18, wherein the product is chosen from a cosmetic product, a hair care product, a sun care product, a make-up product, and a personal hygiene product.

20. A dispenser according to claim 1, wherein the mount is secured to the dispensing adapter by one of bonding, welding, and mechanical attachment.

21. A dispenser according to claim 1, wherein the body of the container includes a first threading, and the dispensing adapter includes a second threading, wherein the second threading engages the first threading to secure the dispensing adapter to the container.

22. A dispenser according to claim 1, wherein the force is generated by the contact of the closure with a surface to which the product is to be applied.

23. A dispenser according to claim 1, wherein the mount is configured such that force applied to the closure moves the closure away from the container body.

24. A dispenser according to claim 1, wherein the mount is configured such that the closure is pulled to the sealed position on the seat when the force is removed.

25. A dispenser for dispensing a product, the dispenser comprising:

a container for containing a product, the container comprising a body having at least one deformable wall and an opening;

a dispensing adapter on the container, the dispensing adapter having a flow passage to be placed in flow communication with the opening of the container, and an outlet orifice forming a seat;

a closure configured to be received in a sealed position on the seat;

a mount connecting the closure to the dispensing adapter, at least a portion of the mount being elastically deformable and being configured such that force applied to the closure moves the closure away from the seat so as to allow the product to flow through the outlet orifice, the closure elastically returning to the sealed position on the seat when the force is removed; and a removable lid configured to immobilize the closure in the sealed position.

26. A method for dispensing a product on a surface, the method comprising:

providing a dispenser for dispensing a product, the dispenser comprising a container for containing a product, the container comprising a body having at least one deformable wall and an opening, a product in the container, a dispensing adapter on the container, the dispensing adapter having a flow passage to be placed in flow communication with the opening of the container, and an outlet forming a seat, a closure configured to be received in a sealed position on the seat, and a mount connecting the closure to the dispensing adapter, the mount having an end secured to the closure, at least a portion of the mount being elastically deformable and being configured such that force applied to the closure moves the closure away from the seat so as to allow the product to flow through the outlet orifice, the closure elastically returning to the sealed position on the seat when the force is removed;

applying a force to the closure to move the closure away from the seat, wherein the force is applied directly to the closure external to the dispensing adapter;

flowing product from the outlet orifice and onto a surface; and releasing the force on the closure to cause elastic return of the closure to the sealed position.

27. A method according to claim 26, further comprising pressing the deformable wall to cause the product to apply the force.

28. A method according to claim 26, wherein the surface includes at least one of skin and hair.

29. A method according to claim 28, wherein the product is chosen from a cosmetic product, a hair care product, a sun care product, a make-up product, and a personal hygiene product.

30. An apparatus for attachment to a container to dispense a product, the apparatus comprising:

a dispensing adapter having a flow passage intended to be placed in flow communication with a container, and an outlet orifice for dispensing a product;

a closure configured to be received in a sealed position on the outlet orifice; and a mount comprising a connecting member, the connecting member having a first end secured to the closure and a second end connected to the flow passage of the dispensing adapter, at least a portion of the mount being elastic, wherein said at least a portion of the mount and the closure are configured such that force applied directly to the closure external to the dispensing adapter moves the closure from the sealed position allowing the product to flow through the outlet orifice, the closure elastically returning to the sealed position when the force is removed.

31. An apparatus according to claim 30, wherein the flow passage comprises a cavity, and the mount includes an attachment element attached to the second end of the connecting member, wherein the attachment element is secured within the cavity.

32. An apparatus according to claim 30, wherein the mount is configured such that the closure is pulled to the sealed position on the seat when the force is removed.

33. An apparatus according to claim 30, wherein the connecting member includes a cleat at the second end, the cleat engaging the flow passage of the dispensing adapter.

34. A method for dispensing a product on a surface, the method comprising:

providing a dispenser for dispensing a product, the dispenser comprising a container for containing a product, the container comprising a body having at least one deformable wall and an opening, a product in the dispense, a dispensing adapter on the container, the dispensing adapter having a flow passage to be placed in flow communication with the opening of the container, and an outlet orifice forming a seat, a closure configured to be received in a sealed position on the seat, and a mount connecting the closure to the dispensing adapter, the mount having an end secured to the closure, at least a portion of the mount being elastically deformable and being configured such that force applied to the closure moves the closure away from the seat so as to allow the product to flow through the outlet orifice, the closure elastically returning to the sealed position on the seat when the force is removed;

applying a force to the closure to move the closure away from the seat, wherein the applying of the force to the closure includes pressing the closure against the surface;

flowing product from the outlet orifice and onto a surface; and releasing the force on the closure to cause elastic return of the closure to the sealed position.

35. A method according to claim 34, further comprising pressing the deformable wall to cause the product to apply force to the closure to move the closure away from the seat.

36. A method according to claim 34, wherein the surface includes at least one of skin and hair.

37. A method according to claim 36, wherein the product is chosen from a cosmetic product, a hair care product, a sun care product, a make-up product, and a personal hygiene product.

38. A method for dispensing a product on a surface, the method comprising:

providing a dispenser for dispensing a product, the dispenser comprising a container for containing a product, the container comprising a body having at least one deformable wall and an opening, a product in the container, a dispensing adapter on the container, the dispensing adapter having a flow passage to be placed in flow communication with the opening of the container, and an outlet orifice forming a seat, a closure configured to be received in a sealed position on the seat, and a mount connecting the closure to the dispensing adapter, at least a portion of the mount being elastically deformable and being configured such that force applied to the closure moves the closure away from the seat so as to allow the product to flow through the outlet orifice, the closure elastically returning to the sealed position on the seat when the force is removed;

applying a force to the closure to move the closure away from the seat;

flowing product from the outlet orifice and onto a surface;

releasing the force on the closure to cause elastic return of the closure to the sealed position; and massaging the product into the surface using the closure.

39. A method according to claim 38, further comprising pressing the deformable wall to cause the product to apply the force.

40. A method according to claim 38, wherein the surface includes at least one of skin and hair.

41. A method according to claim 40, wherein the product is chosen from a cosmetic product, a hair care product, a sun care product, a make-up product, and a personal hygiene product.

42. An apparatus for attachment to a container to dispense a product, the apparatus comprising:

a dispensing adapter having a flow passage intended to be placed in flow communication with a container, and an outlet orifice for dispensing a product;

a closure configured to be received in a sealed position on the outlet orifice; and a mount comprising a connecting member, the connecting member having a first end connected to the closure and a second end connected to the flow passage of the dispensing adapter, at least a portion of the mount being elastic such that a force applied to the closure moves the closure from the sealed position allowing the product to flow through the outlet orifice, the closure elastically returning to the sealed position when the force is removed, wherein the closure comprises a truncated sphere, and a passage passing through the truncated sphere, and wherein the connecting member passes through the passage of the truncated sphere.

43. An apparatus for attachment to a container to dispense a product, the apparatus comprising:

a dispensing adapter having a flow passage intended to be placed in flow communication with a container, and an outlet orifice for dispensing a product;

a closure configured to be received in a sealed position on the outlet orifice; and a mount comprising a connecting member, the connecting member having a first end connected to the closure and a second end connected to the flow passage of the dispensing adapter, at least a portion of the mount being elastic such that a force applied to the closure moves the closure from the sealed position allowing the product to flow through the outlet orifice, the closure elastically returning to the sealed position when the force is removed, wherein the closure and mount are integrally molded, and an axial passage passes through the closure and mount.

44. A dispenser for dispensing a product, the dispenser comprising:

a container for containing a product, the container comprising a body having at least one deformable wall and an opening;

a dispensing adapter on the container, the dispensing adapter having a flow passage to be placed in flow communication with the opening of the container, and an outlet orifice forming a seat;

a closure configured to be received in a sealed position of the seat; and a mount connecting the closure to the dispensing adapter, at least a portion of the mount being elastically deformable, wherein said at least a portion of the mount and the closure are configured such that force applied directly to the closure external to the dispensing adapter moves the closure away from the seat to allow the product to flow through the outlet orifice, and wherein the mount is configured to apply a pulling force to pull the closure to the sealed position on the seat.

45. A dispenser according to claim 44, wherein the dispensing adapter includes an attachment element on an internal surface of the dispensing adapter, and the mount includes a loop member securing the mount to the attachment element.

46. A dispenser according to claim 44, wherein the dispensing adapter includes a cavity defined by an internal surface of the adapter, the mount being secured in the cavity.

47. A dispenser according to claim 44, wherein said at least a portion of the mount is deformable by elastic elongation.

48. A dispenser according to claim 47, wherein the mount includes a connecting member having an end secured to the closure, the connecting member being deformable.

49. A dispenser according to claim 48, wherein said at least a portion of the mount deforms elastically in bending.

50. A dispenser according to claim 44, wherein the force is generated by the contact of the closure with a surface to which the product is to be applied.

51. A dispenser according to claim 44, wherein at least a portion of the closure is at least partially spherical and the seat is shaped to receive said at least a portion of the closure.

52. A dispenser according to claim 44, wherein the closure and the mount are formed from the same material.

53. A dispenser according to claim 44, wherein the mount includes a cross-shaped member attached to a connecting member.

54. A dispenser according to claim 44, further comprising a product in the container.

55. A dispenser according to claim 54, wherein the product is chosen from a cosmetic product, a hair care product, a sun care product, a make-up product, and a personal hygiene product.

56. A dispenser according to claim 44, wherein the mount is secured to the dispensing adapter by one of bonding, welding, and mechanical attachment.

57. A dispenser according to claim 44, wherein the body of the container includes a first threading, and the dispensing adapter includes a second threading, wherein the second threading engages the first threading to secure the dispensing adapter to the container.

58. A dispenser according to claim 44, further comprising a removable lid configured to immobilize the closure in the sealed position.

* * * * *

UNITED STATES PATENT AND TRADEMARK OFFICE

CERTIFICATE OF CORRECTION

PATENT NO. : 6,447,194 B2
DATED : September 10, 2002
INVENTOR(S) : Philippe Bonningue It is certified that error appears in the above-identified patent and that said Letters Patent is hereby corrected as shown below:

Column 9,
Line 57, please change “amount” to -- mount --.
Line 58, please change “elasticallly” to -- elastically --.

Column 12,
Line 29, please change “dispense” to -- dispenser --.

Column 13,
Line 48, please change “sphere,” to -- sphere; --.

Column 14,
Line 12, please change “of” to -- on --.

Signed and Sealed this

Fourth Day of February, 2003

JAMES E. ROGAN
*Director of the United States Patent and Trademark Office*